US008322978B2

(12) United States Patent
Dilovski et al.

(10) Patent No.: US 8,322,978 B2
(45) Date of Patent: Dec. 4, 2012

(54) EXHAUST-DRIVEN TURBOCHARGER FOR A MOTOR VEHICLE

(75) Inventors: Nikolay Dilovski, Stuttgart (DE); Patric Hoecker, Landau (DE); Aurelia Kraemer, Ludwigsburg (DE); Michael Wein, Stuttgart (DE)

(73) Assignee: Mahle International GmbH (DE)

( * ) Notice: Subject to any disclaimer, the term of this patent is extended or adjusted under 35 U.S.C. 154(b) by 521 days.

(21) Appl. No.: 12/465,252

(22) Filed: May 13, 2009

(65) Prior Publication Data

US 2009/0290977 A1 Nov. 26, 2009

(30) Foreign Application Priority Data

May 14, 2008 (DE) ..... 10 2008 023 552

(51) Int. Cl.
*F01D 17/12* (2006.01)

(52) U.S. Cl. ..... 415/164

(58) Field of Classification Search ..... 415/159, 415/160, 163, 164, 165, 168.1, 169.1
See application file for complete search history.

(56) References Cited

U.S. PATENT DOCUMENTS

| | | | |
|---|---|---|---|
| 4,101,241 | A | 7/1978 | Kasuya |
| 2009/0094979 | A1 | 4/2009 | Eissler et al. |

FOREIGN PATENT DOCUMENTS

| | | | |
|---|---|---|---|
| DE | 3724385 | | 2/1989 |
| DE | 10217470 | | 11/2003 |
| DE | 102006018055 | | 10/2007 |
| EP | 0480911 | | 4/1992 |
| WO | WO-2004/022926 | | 3/2004 |
| WO | WO 2004022926 | A1 * | 3/2004 |
| WO | WO-2004/109063 | | 12/2004 |
| WO | WO-2006/015613 | | 2/2006 |
| WO | WO-2006/046892 | | 5/2006 |
| WO | WO 2006046892 | A1 * | 5/2006 |
| WO | WO-2007/011355 | | 1/2007 |

OTHER PUBLICATIONS

English abstract provided for DE-10217470.
English abstract provided for DE-3724385.

* cited by examiner

*Primary Examiner* — Ninh H Nguyen
*Assistant Examiner* — Adam W Brown
(74) *Attorney, Agent, or Firm* — Rader, Fishman & Grauer PLLC

(57) ABSTRACT

An exhaust-driven turbocharger for a motor vehicle includes at least one of a variable turbine and a compressor geometry, a vane-mounting ring with guide vanes mounted rotatably thereon and a guide vane cage. The guide vane cage forms at least part of a flow duct and at the same time a mount for the vane-mounting ring. The guide vane cage is supported by spacer elements while creating an axial gap on a housing of the exhaust-driven turbocharger such that hot gas selectively flows behind the guide vane cage. Also, the guide vane cage is clamped between the turbine housing and the mounting housing of the exhaust-driven turbocharger without fixedly connecting the guide vane cage to either one of the two housings.

16 Claims, 2 Drawing Sheets

EXHAUST-DRIVEN TURBOCHARGER FOR A MOTOR VEHICLE

CROSS-REFERENCES TO RELATED APPLICATION

This application claims priority based on German Patent Application No. 102008023552.0, filed May 14, 2008, which is hereby incorporated by reference in its entirety.

FIELD OF THE INVENTION

The present invention relates to an exhaust-driven turbocharger for a motor vehicle. The invention furthermore relates to an internal combustion engine which is fitted with such an exhaust-driven turbocharger and a motor vehicle which is fitted with such an internal combustion engine.

BACKGROUND OF THE INVENTION

A generic exhaust-driven turbocharger is known for example from WO 2004/022926 A1, in which a housing of the exhaust-driven turbocharger and its adjustable, variable turbine and/or compressor geometry are decoupled mechanically and/or thermally from each other. Thermally induced expansions in particular are intended to be better accommodated by this. A cartridge is screw-fastened to a bearing housing and has an axial gap towards the turbine housing for thermal decoupling.

Generally, all the components of an exhaust-driven turbocharger are usually subject to severe temperature fluctuations during operation and, owing to the use of different materials and different geometries, expansions of different severities, so that these components, as long as they are connected in a fixed manner to each other, can be under great thermal stresses, which in the least favourable case can lead to failure of the actual function or to destruction of the component. The guide vane cage is there for the purpose of forming as small and homogenous a gap as possible to a turbine wheel of the charging device, wherein the gap must be large enough so that wobbling movements of a rotor, which is composed of the turbine wheel and a shaft, as well as manufacturing and assembly tolerances are possible without contact between the turbine wheel and the guide vane cage occurring.

OBJECTS AND SUMMARY OF THE INVENTION

The present invention is concerned with the problem of specifying an improved embodiment for an exhaust-driven turbocharger of the generic type, with which embodiment temperature loads in particular can be better accommodated.

This problem is solved according to the invention. Advantageous embodiments form the subject matter of the invention.

The invention is based on the general idea of mounting a guide vane cage within an exhaust-driven turbocharger in such a manner that hot exhaust gas can flow around it on all sides, so that temperature stresses within the guide vane cage owing to different temperature loads can be virtually entirely ruled out. The exhaust-driven turbocharger can have in a known manner a variable turbine and/or compressor geometry, in particular a vane-mounting ring with guide vanes mounted rotatably thereon. The guide vane cage usually forms at least part of a flow duct and at the same time a mount for the vane-mounting ring. According to the invention, the guide vane cage is now supported by means of spacer elements while creating an axial gap on the housing of the exhaust-driven turbocharger in such a manner that hot exhaust gas can also flow behind the guide vane cage and thereby a uniform temperature loading of the guide vane cage is possible. This means that a temperature gradient within the guide vane cage is kept as low as possible, preferably avoided altogether, as a result of which the mechanical loads, which are brought about as a result of different temperature loads, within the guide vane cage can be kept at an extremely low level. At the same time, it is thereby possible to clamp the guide vane cage simply between a turbine housing and a mounting housing of the exhaust-driven turbocharger without joining it fixedly to one of the two housings, for example by means of screw-fastenings. Until now, such a rear flow as well as a simple clamping has not been possible, from which a not inconsiderable thermal loading of the guide vane cage resulted. With the guide vane cage configured according to the invention, that is, with the spacer elements provided according to the invention, a virtually uniform temperature loading of the guide vane cage is now possible, so that the thermal loading can have an extremely uniform effect on the guide vane cage. This is facilitated by the guide vane cage being clamped between the turbine housing and the bearing housing of the exhaust-driven turbocharger and not being fixed to one of the two housings, for example by means of screw-fastenings.

In an advantageous development of the solution according to the invention, the spacer elements and the guide vane cage are produced from a single piece. The guide vane cage can for example be configured as a formed sheet metal part so that the spacer elements can be produced together with the guide vane cage in a common punching or forming process, as a result of which the guide vane cage per se can be produced in an extremely cost-effective manner.

In a further advantageous embodiment of the solution according to the invention, a total of three spacer elements are provided, between which an angle of approximately 120° is provided. By means of the total of three spacer elements, a statically defined mounting of the guide vane cage, that is a statically defined support of the guide vane cage, on the housing of the exhaust-driven turbocharger is possible, as a result of which the stresses or loads arising from the temperature effects can likewise be kept at an extremely low level.

Further important features and advantages of the invention can be found in the drawings and the associated description of the figures using the drawings.

It is self-evident that the features which are mentioned above and those which are still to be explained below can be used not only in the combination specified in each case, but also in other combinations or alone without departing from the framework of the present invention.

Preferred exemplary embodiments of the invention are shown in the drawings and are explained in more detail in the following description, with the same reference symbols referring to the same or similar or functionally identical components.

DETAILED DESCRIPTION OF THE EXEMPLARY EMBODIMENTS

Figure 1:
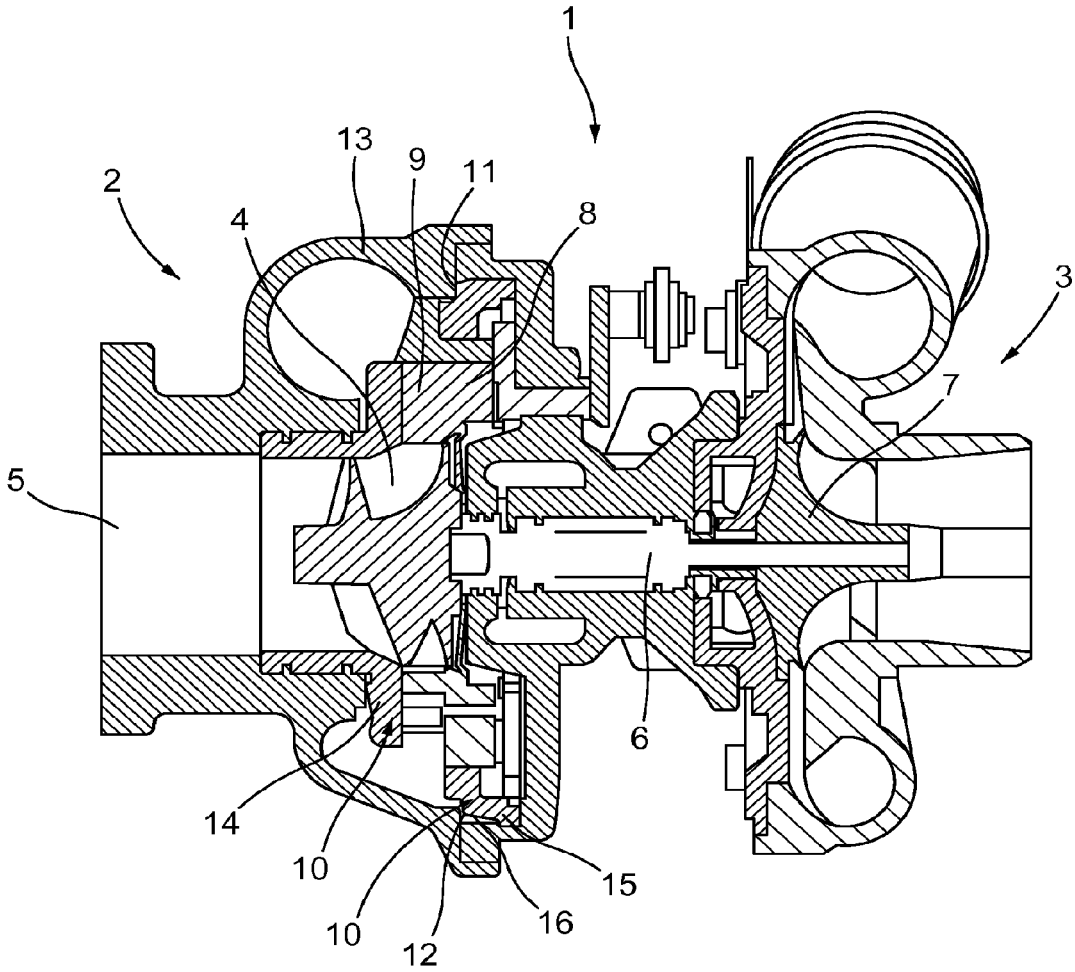
FIG. 1 shows schematically a sectional diagram through an exhaust-driven turbocharger according to the invention.

According to FIG. 1, a charging device according to the invention, which is configured in this case as an exhaust-driven turbocharger 1, has a turbine side 2 and a compressor side 3. A turbine wheel 4 is arranged rotatably on the turbine side 2 in a turbine outlet 5, wherein the latter is connected in a rotationally fixed manner to a compressor wheel 7, which is arranged on the compressor side 3, by means of a shaft 6. In order to influence the output of the exhaust-driven turbocharger 1, the latter has a variable turbine geometry, which is essentially formed by a vane-mounting ring 8 with guide vanes 9 mounted rotatably thereon. The vane-mounting ring 8 is mounted in a guide vane cage 10 (cf. FIG. 2), which at the same time forms at least a part of the turbine outlet 5. As the guide vane cage 10 is directly exposed to the hot exhaust gases, it is subject to a thermal expansion which is not to be underestimated. The guide vane cage 10 is likewise subject to the mechanical stresses resulting from the temperature changes, which stresses are greater, the greater a temperature gradient within the guide vane cage 10. In order to be able to keep the temperature gradients to as low a level as possible, the guide vane cage 10 is supported by means of spacer elements 11 while creating an axial gap 12 on a housing 13, in particular on a turbine housing, of the exhaust-driven turbocharger 1 in such a manner that hot exhaust gas can flow behind the guide vane cage 10 and thereby a uniform heating of the latter is possible. The spacer elements 11 can be seen particularly easily on the guide vane cage 10 according to FIG. 2. Generally, the spacer elements 11 project at least slightly axially beyond the guide vane cage 10 in its arrangement region, so that the guide vane cage 10 bears against the housing 13 of the exhaust-driven turbocharger 1 exclusively by means of the spacer elements 11 and adjacently, that is, in the circumferential direction between them, an axial gap remains, which allows hot exhaust gas to flow around the guide vane cage 10 and thereby allows virtually uniform heating of the latter. At the same time, it is thereby possible to clamp the guide vane cage 10 simply between the turbine housing and the mounting housing of the exhaust-driven turbocharger 1 without joining it fixedly to one of the two housings, for example by means of screw-fastenings.

Generally, the guide vane cage 10 can be configured as a single-piece, cost-effective formed sheet metal part, with it furthermore being conceivable for the spacer elements 11 and the guide vane cage 10 to be produced from a single piece. Such a production is possible for example by means of a combined punching/forming and/or stamping process. According to FIG. 2, a total of three spacer elements are provided on the guide vane cage 10, between which an angle of approximately 120° exists. Of course, more than three spacer elements 11 are also conceivable, with a statically defined mounting being made possible in particular with three spacer elements 11.

Figure 2:
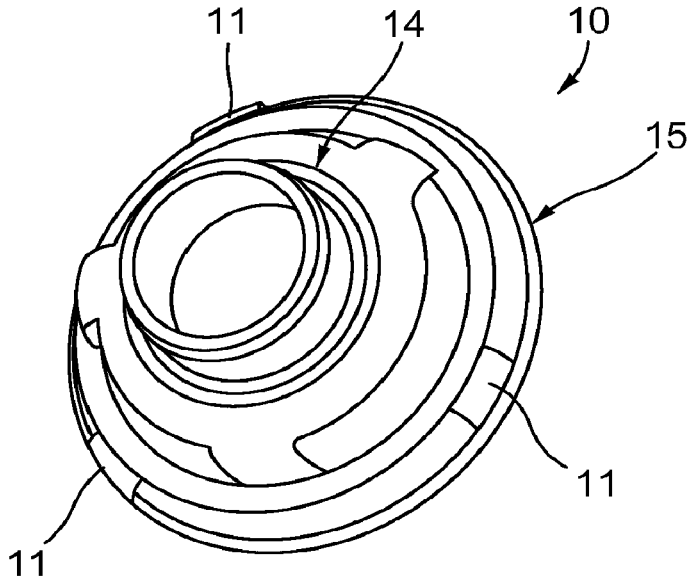
FIG. 2 shows schematically different views of a guide vane cage according to the invention.
Figure 2:
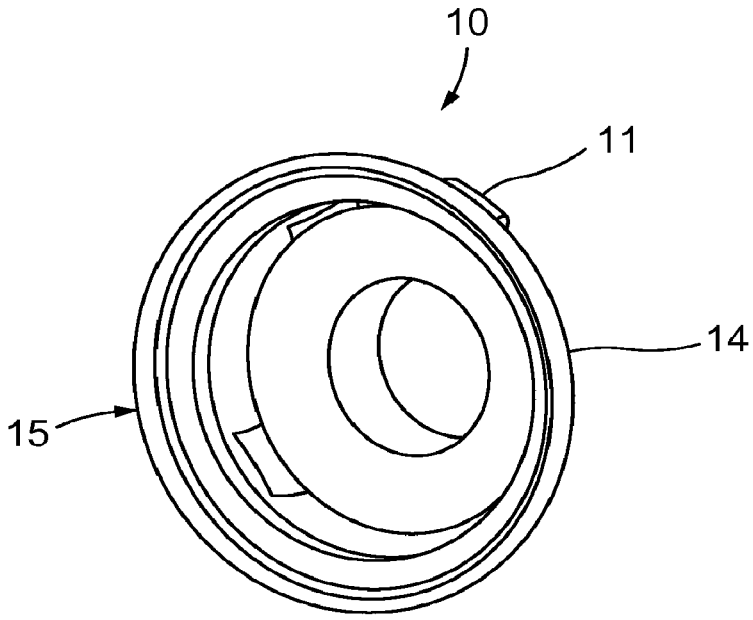

As can be seen in FIG. 2, the guide vane cage 10 has a radially stepped configuration, with a first annular step 14, which encloses the turbine wheel 4, and with a second annular step 15, which bears the vane-mounting ring 8. The spacer elements 11 are arranged or integrally formed in the region of the second annular step 15 according to FIG. 2.

With the guide vane cage 10 according to the invention, it is possible for hot exhaust gas to get into a space 16 and thus behind the guide vane cage 10 during operation of the exhaust-driven turbocharger 1, so that the guide vane cage can be heated uniformly, that is in particular with low stress, by the hot exhaust gas. In a full-area bearing of the guide vane cage 10 on the housing 13 of the exhaust-driven turbocharger 1 of the prior art, such a flow of hot exhaust gas behind the guide vane cage 10 is not possible, as the axial gap 12 is closed in this case. This produces a temperature gradient, which is not to be underestimated, within the guide vane cage 10, as a result of which the latter is exposed to not inconsiderable mechanical loads caused by the thermal expansions. With the guide vane cage 10 according to the invention, in contrast, it is possible for the latter to be heated virtually uniformly, as a result of which the temperature gradient within the guide vane cage 10 can be greatly reduced. At the same time, it is thereby possible to clamp the guide vane cage 10 simply between the turbine housing and the bearing housing of the exhaust-driven turbocharger 1 without joining it fixedly to one of the two housings, for example by means of screw-fastenings. The reduction of the mechanical loads acting on the guide vane cage 10 makes it possible for the latter to be configured correspondingly weaker or else a higher service life to be achieved with the same configuration. As integrally forming or providing the spacer elements 11 is extremely simple, in particular can be produced in a common manufacturing step with the guide vane cage 10, the achieved effect can be achieved with comparatively low expense.

An exhaust-driven turbocharger 1 which is equipped with such a guide vane cage 10 can for example be a component of an internal combustion engine which is used in a motor vehicle.

The invention claimed is:

1. An exhaust-driven turbocharger for a motor vehicle, comprising:

at least one of a variable turbine and a compressor geometry a vane-mounting ring with guide vanes mounted rotatably thereon, a guide cane cage which forms at least part of a flow duct and at the same time a mount for the vane-mounting ring, the guide vane cage disposed in the turbine housing and having a first annular step portion and a second annular step portion fixedly connected to the first annular step portion, the first annular step portion disposed in the turbine housing to surround at least a portion of the guide vanes in a close-fitting, spaced-apart manner, the guide vane cage fixedly connected to and arranged between a turbine housing and a turbine mounting base by a compression force when the turbine housing and the turbine mounting base are releasably connected together, wherein the first annular step portion comprises a first step flange portion and the second annular step portion comprises a second step flange portion which includes a plurality of spacer elements integrally formed therewith, each one of the plurality of spacer elements extends radially from at least an outer peripheral edge portion of the second annular step portion and projects axially from the at least an outer peripheral edge portion of the second annular step portion towards the first step flange portion such that a radially-extending spacer element surface of each one of the plurality of spacer elements is disposed between the first step flange portion and the second step flange portion so that an axial gap is formed between the turbine housing and the second step flange portion and wherein the guide vane cage is clamped by a compression force between the turbine housing and the mounting housing of the exhaust-driven turbocharger when the turbine housing and the mounting housing are connected together, the compression force being applied to the spacer elements.

2. The exhaust-driven turbocharger according to claim 1, wherein the guide vane cage is configured as a single-part formed sheet metal part.

3. The exhaust-driven turbocharger according to claim 2, wherein the spacer elements and the guide vane cage are produced from one piece.

4. The exhaust-driven turbocharger according to claim 2, wherein three spacer elements are provided, between which an angle of approximately 120° is provided.

5. The exhaust-driven turbocharger according to claim 2, wherein the guide vane cage has a radially stepped configuration and encloses a turbine wheel with a first annular step and bears the vane-mounting ring with a second annular step.

6. The exhaust-driven turbocharger according to claim 1, wherein the spacer elements and the guide vane cage are produced from one piece.

7. The exhaust-driven turbocharger according to claim 6, wherein the guide vane cage has a radially stepped configuration and encloses a turbine wheel with a first annular step and bears the vane-mounting ring with a second annular step.

8. The exhaust-driven turbocharger according to claim 1, wherein three spacer elements are provided, between which an angle of approximately 120° is provided.

9. The exhaust-driven turbocharger according to claim 8, wherein the guide vane cage has a radially stepped configuration and encloses a turbine wheel with a first annular step and bears the vane-mounting ring with a second annular step.

10. The exhaust-driven turbocharger according to claim 9, wherein the spacer elements are arranged in a region of the second annular step.

11. The exhaust-driven turbocharger according to claim 1, wherein the guide vane cage has a radially stepped configuration and encloses a turbine wheel with a first annular step and bears the vane-mounting ring with a second annular step.

12. A turbine for an exhaust-driven turbocharger, comprising:

a turbine housing;

a turbine mounting base releasably connected to the turbine housing;

a turbine impeller rotatably disposed in the turbine housing and the turbine mounting base and having a vane-mounting ring with guide vanes mounted thereon; and a guide vane cage disposed in the turbine housing and having a first annular step portion and a second annular step portion fixedly connected to the first annular step portion, the first annular step portion disposed in the turbine housing to surround at least a portion of the guide vanes in a close-fitting, spaced-apart manner, the second annular step portion surrounding the vane-mounting ring in a close-fitting, spaced-apart manner, the guide vane cage fixedly connected to and arranged between the turbine housing and the turbine mounting base by a compression force when the turbine housing and the turbine mounting base are releasably connected together, wherein the first annular step portion comprises a first step flange portion and the second annular step portion comprises a second step flange portion which includes a plurality of spacer elements integrally formed therewith, each one of the plurality of spacer elements extends radially from at least an outer peripheral edge portion of the second annular step portion and projects axially from the at least an outer peripheral edge portion of the second annular step portion towards the first step flange portion such that a radially-extending spacer element surface of each one of the plurality of spacer elements is disposed between the first step flange portion and the second step flange portion so that an axial gap is formed between the turbine housing and the second step flange portion.

13. A turbine according to claim 12, wherein the first annular step portion includes a first step cylinder part extending along and about an axial centreline and a first step flange portion connected at an end of the first step cylinder part and extending radially outwardly therefrom.

14. A turbine according to claim 13, wherein the second annular step portion includes a second step cylinder part extending along and about the axial centreline and a second step flange portion connected at an end of the second step cylinder part and extending radially inwardly therefrom.

15. A turbine according to claim 14, wherein the first annular step portion and the second annular step portion are axially disposed apart from one another and are connected at an outer peripheral edge of the first step flange portion and an inner peripheral edge of the second step flange portion.

16. A turbine according to claim 12, wherein the plurality of spacer elements includes three spacer elements disposed circumferentially apart from each other in approximately 120° increments.

* * * * *

UNITED STATES PATENT AND TRADEMARK OFFICE

CERTIFICATE OF CORRECTION

PATENT NO. : 8,322,978 B2
APPLICATION NO. : 12/465252
DATED : December 4, 2012
INVENTOR(S) : Dilovski et al.

It is certified that error appears in the above-identified patent and that said Letters Patent is hereby corrected as shown below:

In the Claims

At column 4, claim number 1, line number 30, change “cane cage” to “vane cage”

Signed and Sealed this
Twenty-first Day of May, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,322,978 B2
APPLICATION NO. : 12/465252
DATED : December 4, 2012
INVENTOR(S) : Nikolay Dilovski et al.

It is certified that error appears in the above-identified patent and that said Letters Patent is hereby corrected as shown below:

On the Title Page:

Item [73] Assignee, change Assignee name from "Mahle International GmbH (DE)" to "Bosch Mahle Turbo Systems GmbH & Co. KG"

Signed and Sealed this
Eighth Day of October, 2013

Teresa Stanek Rea
*Deputy Director of the United States Patent and Trademark Office*